US009765565B2

(12) United States Patent
Morris

(10) Patent No.: US 9,765,565 B2
(45) Date of Patent: Sep. 19, 2017

(54) CORDLESS SHADE AUTOMATIC LIFT REGULATOR

(71) Applicant: Springs Window Fashions, LLC, Middleton, WI (US)

(72) Inventor: John Morris, Middleton, WI (US)

(73) Assignee: SPRINGS WINDOW FASHIONS, LLC, Middleton, WI (US)

( * ) Notice: Subject to any disclaimer, the term of this patent is extended or adjusted under 35 U.S.C. 154(b) by 0 days.

(21) Appl. No.: 15/013,409

(22) Filed: Feb. 2, 2016

(65) Prior Publication Data

US 2016/0222723 A1 Aug. 4, 2016

Related U.S. Application Data

(60) Provisional application No. 62/110,781, filed on Feb. 2, 2015.

(51) Int. Cl.

| | |
|---|---|
| ***E06B 9/322*** | (2006.01) |
| ***E06B 9/262*** | (2006.01) |
| *E06B 9/24* | (2006.01) |

(52) U.S. Cl.

CPC ..... *E06B 9/322* (2013.01); *E06B 9/262* (2013.01); *E06B 2009/2441* (2013.01); *E06B 2009/2627* (2013.01); *E06B 2009/3222* (2013.01)

(58) Field of Classification Search

CPC .... E06B 9/322; E06B 2009/3222; E06B 9/84; E06B 2009/802; E06B 2009/807; F16D 67/02; F16D 19/00; F16H 3/34

USPC ..... 74/397, 352

See application file for complete search history.

(56) References Cited

U.S. PATENT DOCUMENTS

| | | | | |
|---|---|---|---|---|
| 4,733,711 | A | 3/1988 | Schon | |
| 5,117,893 | A | 6/1992 | Morrison et al. | |
| 5,328,113 | A | 7/1994 | de Chevron Villette et al. | |
| 5,341,864 | A | 8/1994 | Rupel et al. | |
| 5,357,712 | A | 10/1994 | Streeter | |
| 6,705,379 | B1 | 3/2004 | Nien | |
| 6,968,885 | B2 | 11/2005 | Nien | |
| 7,063,122 | B2 | 6/2006 | Colson et al. | |
| 7,143,802 | B2 | 12/2006 | Strand et al. | |
| 7,454,994 | B2 * | 11/2008 | Mamba | F16H 3/40 74/352 |
| 7,464,742 | B2 | 12/2008 | Oskam et al. | |
| 7,624,785 | B2 | 12/2009 | Yu et al. | |

(Continued)

FOREIGN PATENT DOCUMENTS

| | | |
|---|---|---|
| DE | 20/2007010768 | 12/2007 |
| DE | 20/2013000031 | 1/2013 |
| DE | 202014104193 | 9/2014 |

OTHER PUBLICATIONS

EP16153878.0 Extended European Search Report dated Jun. 10, 2016 (8 pages).

*Primary Examiner* — Blair M Johnson

(74) *Attorney, Agent, or Firm* — Michael Best & Friedrich LLP

(57) ABSTRACT

A covering for an architectural opening including a first rail, a second rail moveable relative to the first rail, and a lift regulator coupled to the first rail. The lift regulator includes a drag mechanism, and the lift regulator automatically engages the drag mechanism to resist the second rail moving away from the first rail. In addition, the lift regulator automatically disengages the drag mechanism when the second rail moves toward the first rail.

18 Claims, 7 Drawing Sheets

(56) References Cited

U.S. PATENT DOCUMENTS

| | | | | |
|---|---|---|---|---|
| 7,740,045 | B2 | 6/2010 | Anderson et al. | |
| 8,118,077 | B2 | 2/2012 | Pflieger | |
| 8,230,896 | B2 | 7/2012 | Anderson et al. | |
| 8,347,937 | B2 | 1/2013 | Murphy | |
| 8,511,364 | B2 * | 8/2013 | Anderson | E06B 9/262 160/84.05 |
| 8,522,852 | B2 | 9/2013 | Yu et al. | |
| 8,573,281 | B2 | 11/2013 | Drew et al. | |
| 8,763,673 | B2 | 7/2014 | Jelic et al. | |
| 8,905,114 | B1 | 12/2014 | Whitaker | |
| 8,938,867 | B2 * | 1/2015 | Filiatrault | F16H 3/34 219/76.1 |
| 2008/0314530 | A1 * | 12/2008 | Cheng | E06B 9/322 160/170 |
| 2011/0120823 | A1 * | 5/2011 | Hansen | E01F 13/028 188/272 |
| 2011/0290429 | A1 * | 12/2011 | Cheng | E06B 9/262 160/84.02 |
| 2012/0234502 | A1 | 9/2012 | Chen | |
| 2012/0267060 | A1 | 10/2012 | Anderson et al. | |
| 2013/0087296 | A1 | 4/2013 | Mullet et al. | |
| 2013/0233499 | A1 | 9/2013 | Wu | |
| 2014/0014279 | A1 | 1/2014 | Defenbaugh et al. | |
| 2014/0076504 | A1 | 3/2014 | Anthony et al. | |
| 2016/0222723 | A1 * | 8/2016 | Morris | E06B 9/262 |

* cited by examiner

CORDLESS SHADE AUTOMATIC LIFT REGULATOR

CROSS-REFERENCE TO RELATED APPLICATIONS

This application claims priority to U.S. Provisional Patent Application No. 62/110,781, filed on Feb. 2, 2015, and entitled "Cordless Shade Automatic Lift Regulator," the contents of which is hereby incorporated by reference in its entirety.

FIELD OF INVENTION

The present invention relates to architectural coverings, and more specifically to cordless window shades.

BACKGROUND

It should be appreciated that a "cordless" shade generally refers to a shade that is positioned (or repositioned) by manually adjusting one or more rails, instead of adjusting rail position by a drawstring (or a draw cord). A "cordless" shade does not require that all cords associated with the shade be eliminated, as a "cordless" shade can include, for example, lift cords that extend between rails.

The positioning of a cordless shade is manually adjusted by a user. Once a user has selected a position for the cordless shade, it is desirable to maintain the cordless shade in the position selected by the user, minimizing any upwards or downwards creep of the cordless shade.

SUMMARY

The invention provides, in one aspect, a covering for an architectural opening including a first rail, a second rail moveable relative to the first rail, and a lift regulator coupled to the first rail. The lift regulator includes a drag mechanism, and the lift regulator automatically engages the drag mechanism to resist the second rail moving away from the first rail. In addition, the lift regulator automatically disengages the drag mechanism when the second rail moves toward the first rail.

The invention provides, in yet another aspect, a lift regulator including a housing defining a slot, a drive gear, and a floating gear enmeshed with the drive gear. The floating gear includes a shaft positioned within the slot. The lift regulator further includes a drag gear and an adjustable drag mechanism engaged with the drag gear. The floating gear is enmeshed with the drag gear when the drive gear rotates in a first direction and the floating gear is separated from the drag gear when the drive gear rotates in a second direction.

The invention provides, in yet another aspect, a covering for an architectural opening including a first rail, a second rail moveable relative to the first rail, and a spring motor coupled to the first rail and drivingly coupled to a drive shaft. The covering further includes a lift regulator coupled to the first rail. The lift regulator includes a drive gear coupled to the drive shaft and a floating gear enmeshed with the drive gear. A portion of the floating gear is positioned within a slot. The lift regulator further includes a drag gear including a hub and an adjustable drag mechanism partially surrounding the hub of the drag gear. The drive gear rotates in a first direction when the second rail is moved away from the first rail, and in a second direction when the second rail is moved toward the first rail. The floating gear is enmeshed with the drag gear when the drive gear rotates in the first direction, and the floating gear is separated from the drag gear when the drive gear rotates in the second direction.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
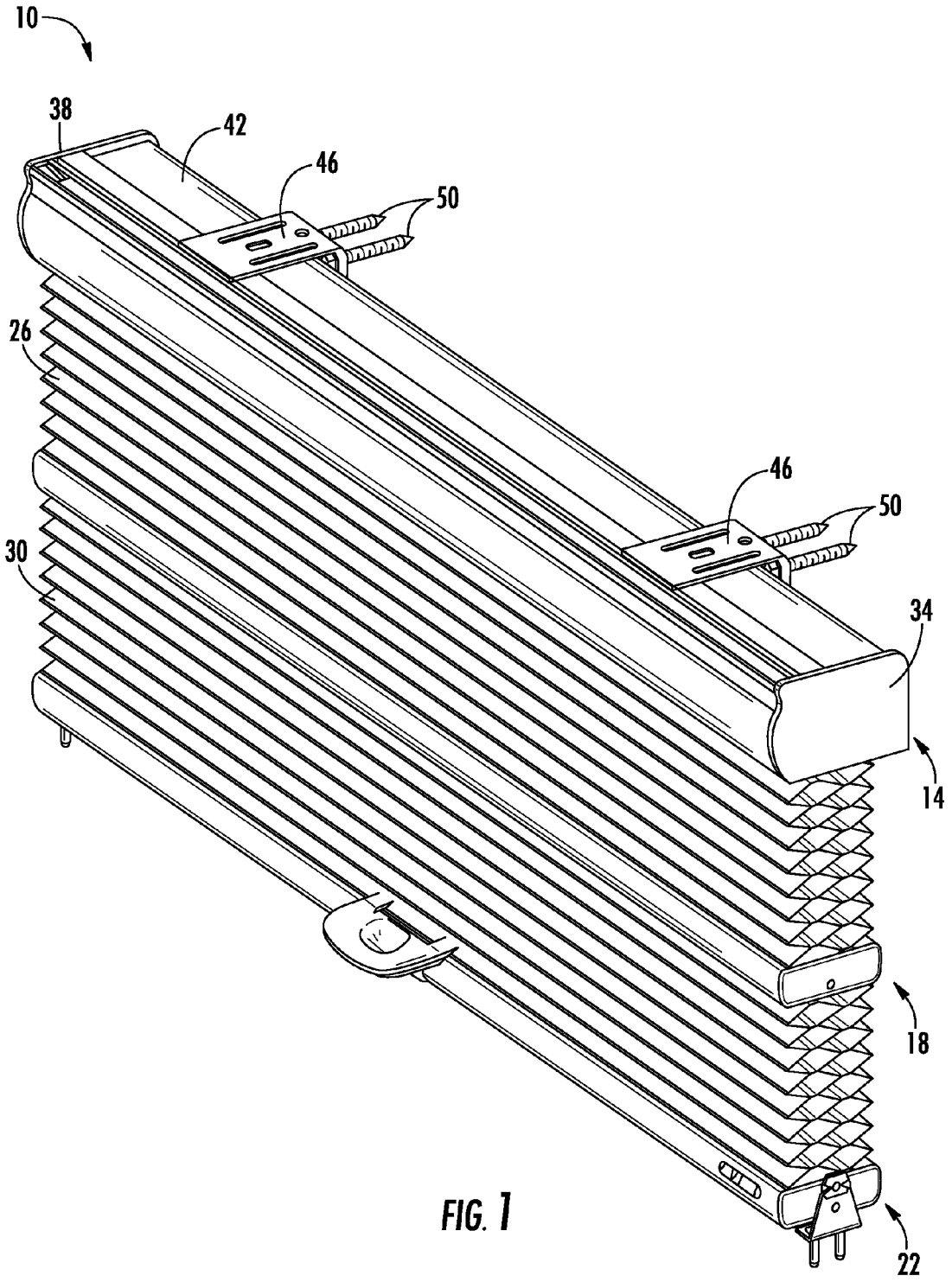
FIG. 1 is a perspective view of a window covering in accordance with an embodiment of the invention.
Figure 2:
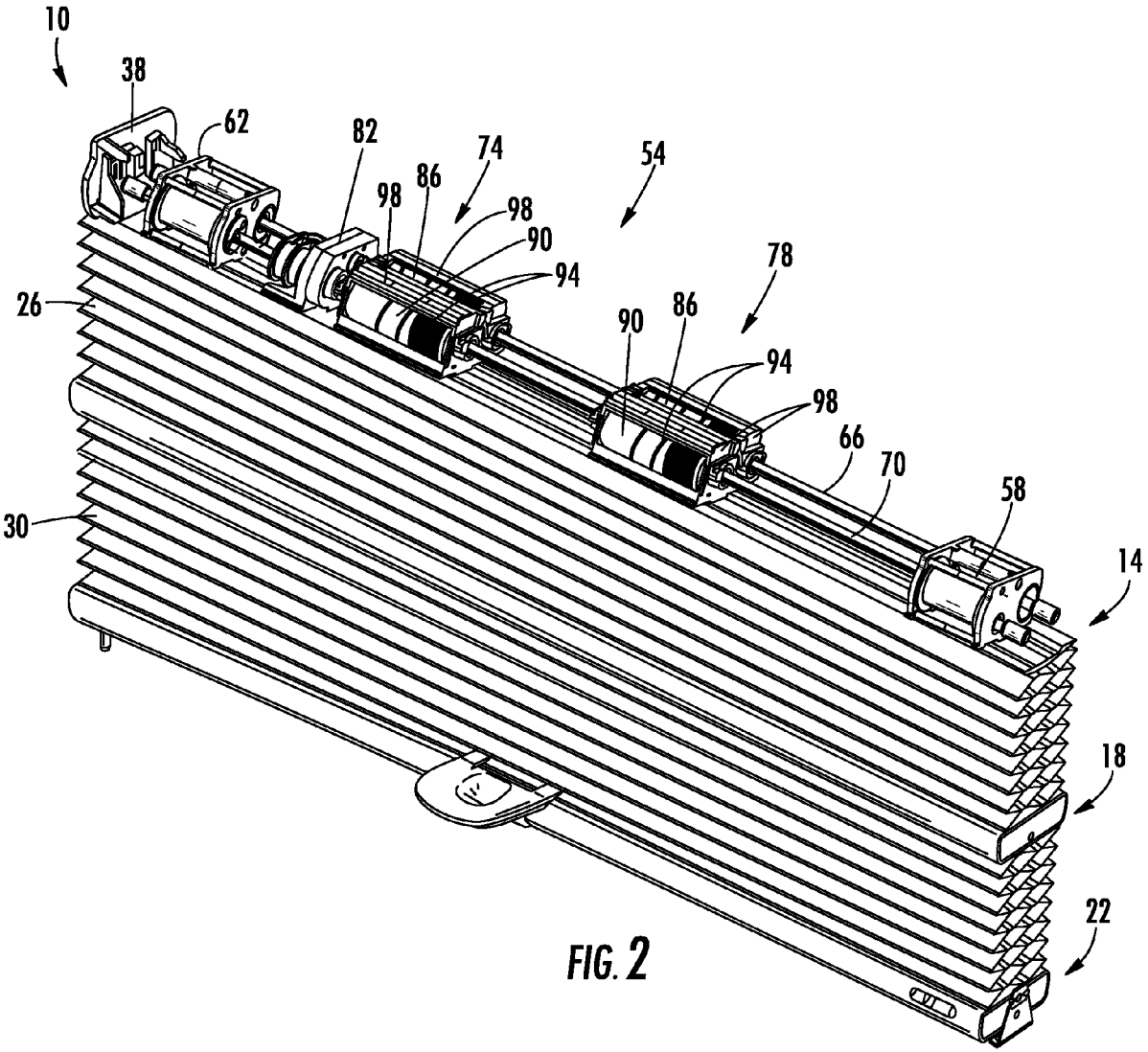
FIG. 2 is another perspective view of the window covering of FIG. 1 with portions removed for clarity to illustrate a lift assembly including a lift regulator.

With reference to FIGS. 1-2, a multi-panel covering 10 for an architectural opening (e.g., a window, etc.) is illustrated with a head rail 14, an intermediate rail 18, and a bottom rail 22. The multi-panel window covering 10 further includes an upper window covering panel 26 extending between the head rail 14 and the intermediate rail 18, and a lower window covering panel 30 extending between the intermediate rail 18 and the bottom rail 22. The intermediate rail 18 is moveable with respect to the head rail 14, and the bottom rail 22 is moveable with respect to the intermediate rail 18 and the head rail 14. The head rail 14 includes a first end cap 34 and a second end cap 38 positioned at opposite ends of the head rail 14, and a dust cover 42. A plurality of mounting brackets 46 are provided for attaching the multi-panel window covering 10 to, for example, a wall adjacent a window, a ceiling above a window, or a surface on the window itself. In the illustrated embodiment, the brackets 46 are configured to receive a plurality of fasteners 50 for anchoring the brackets 46 to the wall, ceiling, or window structure.

With continued reference to FIG. 1, the upper window covering panel 26 is positioned above the lower window covering panel 30. The window covering panels 26, 30 may have different characteristics, including but limited to: light blocking ability, color, structure, or aesthetic appearance. For example, one of the window covering panels can be relatively sheer for allowing significant light to pass there through while obscuring vision through the window, and the other panel can be opaque so as to provide room darkening. In the illustrated embodiment, the upper and lower window covering panels 26, 30 are cellular fabrics. More specifically, the panels 26, 30 are illustrated as double-cell cellular fabrics but any number of cells (i.e., single or multi-cell) fabrics may be used. In alternative embodiments, the upper and lower window covering panels are pleated fabrics. Additionally or alternatively, any combination of pleated, cellular fabrics, or other types of window covering material (e.g., Venetian blinds) can be used. In further alternative embodiments, the upper window covering panel is removed (i.e., no window covering material is provided between the head rail 14 and the intermediate rail 18). Also, in alternative embodiments, the window covering is a single panel window covering (i.e., including only a head rail and a bottom rail).

With reference to FIG. 2, a lift assembly 54 for the multi-panel window covering 10 is positioned within a substantially enclosed space that is at least partially defined by the dust cover 42 and the end caps 34, 38 of the head rail 14. The dust cover 42 and other portions have been removed in FIG. 2 for clarity purposes. The lift assembly 54 is coupled to the head rail 14 and includes a first spring motor 58, a second spring motor 62, a first drive shaft 66 (i.e., a drive rod), a second drive shaft 70, a first cradle assembly 74, a second cradle assembly 78, and a lift regulator 82. U.S. Pat. No. 7,143,802 provides additional disclosure regarding the components contained in the first and second spring motor 58, 62, and is incorporated herein by reference in its entirety. In the illustrated embodiment, the first spring motor 58 is drivingly coupled to the first drive shaft 66 and the second spring motor 62 is drivingly coupled to the second drive shaft 70. The first cradle assembly 74 and the second cradle assembly 78 are both coupled to each of the first and second drive shafts 70, 74. As explained in greater detail below, the first and second spring motors 58, 62 are provided for assisting a user with lifting the intermediate and bottom rails 18, 22 (including the upper and lower window covering panels 26, 30) between the fully extended and fully retracted positions.

With continued reference to FIG. 2, each of the first and second cradle assemblies 74, 78 includes a first winding drum 86 and a second winding drum 90. Lift cords 94 are partially wound around the winding drums 86, 90 and extend from the winding drums 86, 90 to the intermediate rail 18 and the bottom rail 22. The first and second spring motors 58, 62 are connected to the drive shafts 66, 70, respectively, and the drive shafts 66, 70 are connected to the winding drums 86, 90 for winding on and winding off lift cords 94 connected between the head rail 14 and the intermediate rail 18 or the bottom rail 22. In the illustrated embodiment, two lift cords 94 are provided between the head rail 14 and the bottom rail 22, and two other lift cords 94 are provided between the head rail 14 and the intermediate rail 18. One winding drum 86, 90 is provided for each lift cord 94 used in the window covering 10. Accordingly, in the illustrated embodiment, four winding drums 86, 90 are provided for the four lift cords 94 shown with two winding drums 86 for the two lift cords 94 extending between the head rail 14 and the bottom rail 22, and two winding drums 90 for the two lift cords 94 extending between the head rail 14 and the intermediate rail 18. In the illustrated embodiment, each cradle assembly 74, 78 includes two lift cords 94 with one lift cord 94 extending between the head rail 14 and the bottom rail 22 and the other lift cord 94 extending between the head rail 14 and the intermediate rail 18.

In other words, the first spring motor 58 is provided for working together with lift cords 94 connected between the head rail 14 and the bottom rail 22, and the second spring motor 62 is provided for working together with the lift cords 94 connected between the head rail 14 and the intermediate rail 18. The spring motors 58, 62 include a spring therein to store energy as the window covering is extended so that the stored energy can be utilized to assist lifting the window covering material from a more extended position to a more retracted position.

The lift cords 94 extend through internal holes or openings of the window covering panels 26, 30 so as not to be visible in the cellular panels and only minimally visible through the pleated panels. As the window covering panels 26, 30 are extended or retracted, the lift cords move relative to the panels 26, 30 so that the panels 26, 30 are compressed or extended. Two of the lift cords 94 extend only through the upper window covering panel 26 and are attached to the intermediate rail 18. Accordingly, extending or retracting the unwound the length of these two lift cords 94 adjust the position of the intermediate rail 18 relative to the head rail 14 and thereby the amount of exposure of the upper window covering panel 26 between the head rail 14 and the intermediate rail 18. The other two lift cords 94 extend through the upper window covering panel 26, through the intermediate rail 18, through the lower window covering panel 30 and are attached to the bottom rail 22. Accordingly, extending or retracting the unwound length of these two later described lift cords 94 adjust the position of the bottom rail 22 relative to the head rail 14 and, together with the positioning of the intermediate rail 18 relative to the head rail 14 one determines the amount of exposure of the lower window covering panel 30 between the intermediate rail 18 and the bottom rail 22.

With continued reference to FIG. 2, the winding drums 86, 90 for each pair of lift cords 94 are provided in front to back relationships immediately above the lift cord paths through the material panels 26, 30. Accordingly, in each pair of lift cords 94, one lift cord engages the forward winding drum 90 and the other lift cord engages the rear word winding drum 86. The forward winding drums 90 are engaged on the same drive shaft 70 and are thereby connected to the same spring motor assembly 62. The rear word winding drums 90 are engaged on the other drive shaft 66 and are thereby connected to the other spring motor assembly 58. The two lift cords 94 connected to bottom rail 22 are engaged with the rearward winding drums 86 and the two lift cords 94 connected to the intermediate rail 18 are engaged with the forward winding drums 90. Accordingly, both lift cords 94 connected to the bottom rail 22 are operated by the same spring motor assembly 58 and both lift cords 94 connected to the intermediate rail 18 are operated by the other spring motor assembly 62.

The first and second cradle assemblies 74, 78 are provided for holding each pair of winding drums 86, 90 in forward and rearward positions while allowing the winding drums 86, 90 to rotate for accumulating and dispensing the lift cords 94 engaged therewith. Each cradle assembly 74, 78 includes two pivoting cradle covers 98. Each cover 98 has a wear bar over which the lift cords 94 are threaded. The lift cords 94 bias the wear bar and cause the cover 98 to pivot into engagement with the drums 86, 90, resulting in a braking force between the winding drum 86, 90 and the pivoting cover 98 to resist the rotation of the winding drum 86, 90.

Figure 3:
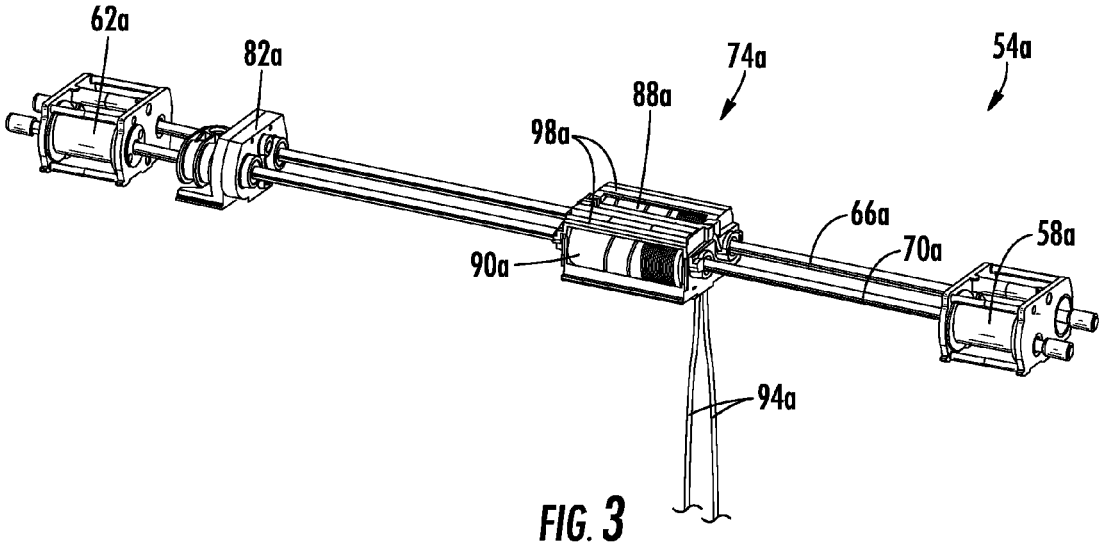
FIG. 3 is a perspective view of a lift assembly including a lift regulator in accordance with an embodiment of the invention.

Another embodiment of a lift assembly **54*a* is shown in FIG. 3. Like features and components are shown with like reference numerals plus the letter "a." The lift assembly 54*a* includes a first spring motor 58*a*, a second spring motor 62*a*, a first drive shaft 66*a* (i.e., a drive rod), a second drive shaft 70*a*, a first cradle assembly 74*a*, and a lift regulator 82*a*. In the illustrated embodiment, the first spring motor 58***a* is drivingly coupled to the first drive shaft 66*a* and the second spring motor 62*a* is drivingly coupled to the second drive shaft 70*a*. The first cradle assembly 74*a* is coupled to each of the first and second drive shafts 66*a*, 70*a*. The first and second spring motors 58*a*, 62*a* are provided for assisting a user with lifting an intermediate and bottom rail (including an upper and lower window covering panels) between the fully extended and fully retracted positions. The main difference between the lift assembly 54 of FIG. 2 and the lift assembly 54*a* of FIG. 3 is the lift assembly 54*a* only includes a single cradle assembly 74*a*. In other words, the lift assembly 54*a* of FIG. 3 is more suited for a relatively narrow window covering. In further alternative embodiments, more or less than two lift cords (and corresponding winding drums) may be included between the head rail and the intermediate or bottom rail when the window covering is a lesser or greater width.

In the context the lift assembly 54 embodiment shown in FIG. 2, the drive shaft 66 corresponding to the bottom rail 22 is drivingly coupled to the lift regulator 82. As such, movement of the bottom rail 22 with respect to the head rail 14 causes rotation of the drive shaft 66, which is coupled to the lift regulator 82. The lift regulator 82 is removably coupled to the drive shaft 66. In other words, the lift regulator 82 is modular and can be applied to any existing lift assembly. As explained in greater detail below, the lift regulator 82 automatically provides a drag force (i.e., resistance, brake, etc.) when the bottom rail 22 is moved away from the head rail 14 or is statically hanging, and the lift regulator 82 automatically removes any drag force when the bottom rail 22 is moved toward the head rail 14. In alternative embodiments, the lift regulator 82 is coupled to the drive shaft 70 corresponding to the intermediate rail 18. In further alternative embodiment, each of the drive shafts 66, 70 are coupled to a lift regulator. The lift regulator 82 can also be utilized on lift assemblies for a single panel window covering embodiments (i.e., including only a head rail and a bottom rail).

Figure 4:
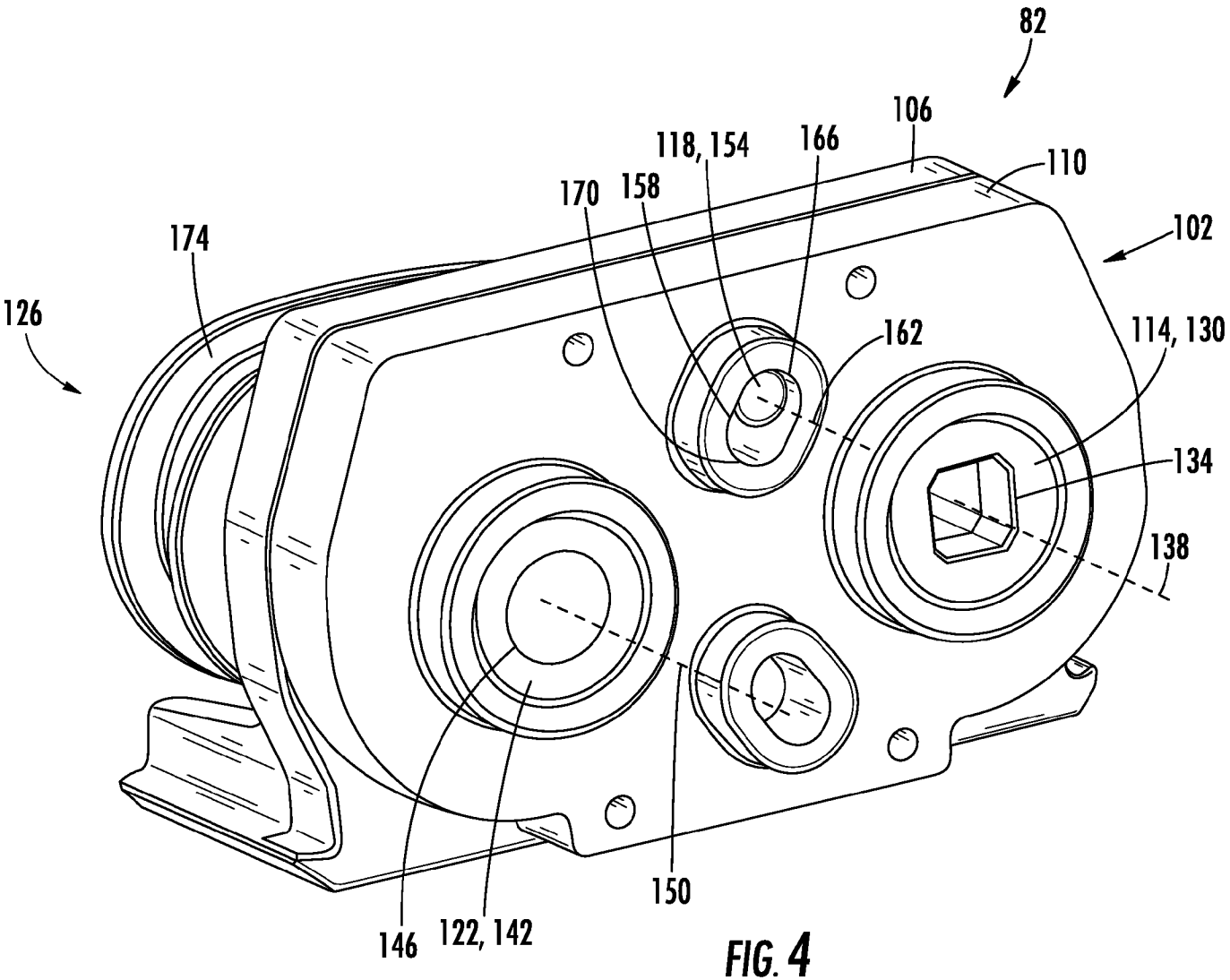
FIG. 4 is a perspective view of the lift regulator of FIGS. 2 and 3.
Figure 5:
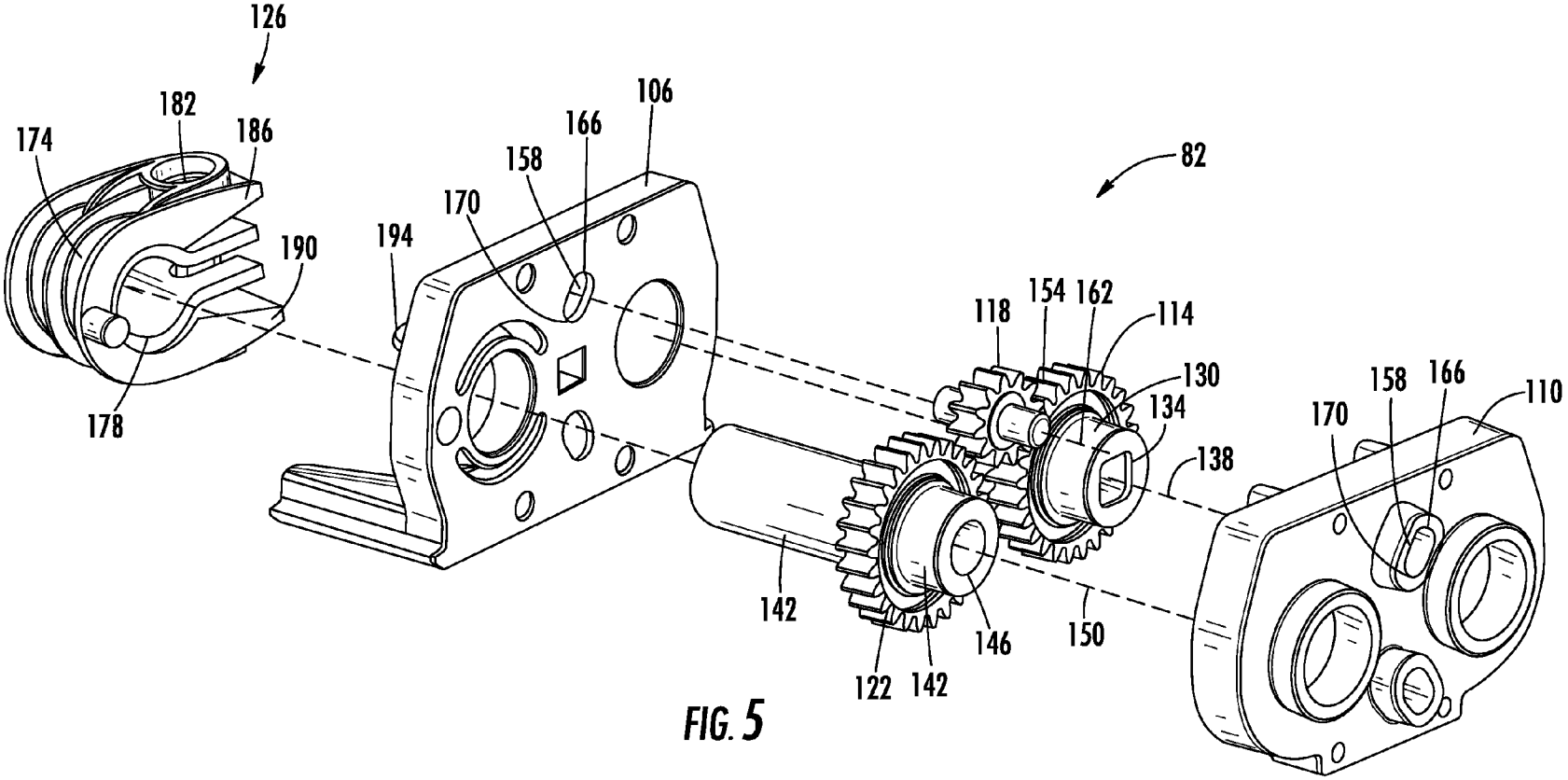
FIG. 5 is an exploded view of the lift regulator of FIG. 4.

With reference to FIGS. 4 and 5, the lift regulator 82 shown in the lift assembly 54 of FIG. 2 is shown in greater detail. The lift regulator 82 includes a housing 102 formed from two clam shell members 106, 110. The lift regulator 82 further includes a drive gear 114, a floating gear 118 enmeshed with the drive gear 114, a drag gear 122, and an adjustable drag mechanism 126. The drive gear 114 is rotatably supported by the housing 102 and includes a hub 130 defining an aperture 134 and a drive axis 138. In the illustrated embodiment, the aperture 134 is square-shaped to correspond to the square-shaped drive shaft 66. In other words, the drive shaft 66 is removably received within the aperture 134 to rotate the drive gear 114 about the drive axis 138.

With continued reference to FIGS. 4 and 5, the drag gear 114 is rotatably supported by the housing 102 and includes a hub 142 defining an aperture 146 and a drag axis 150. In the illustrated embodiment, the drag axis 150 is parallel to the drive axis 138. The aperture 146 is circular and is configured to receive a square-shaped drive shaft but to not transmit torque between a drive shaft and the hub 142. In other words, the drive shaft 70 passes through the drag gear 122 along the drag axis 150 but is not coupled to the drag gear 122 (FIG. 2).

With continued reference to FIGS. 4 and 5, the floating gear 118 is enmeshed with the drive gear 114 and the floating gear 118 is rotatably and slidably supported by the housing 102. More specifically, the floating gear 118 includes a shaft 154 that is positioned within a slot 158 (i.e., a channel) formed in the housing 102. In the illustrated embodiment, the slot 158 is partially formed by each of the housing clam shells 106, 110, and the slot 158 is oriented obliquely to the drive axis 138 and the drag axis 150. The shaft 154 defines a floating axis 162 of the floating gear 118, and the floating axis 162 is parallel to the drive axis 138 and the drag axis 150. As described in greater detail below, the shaft 154 of the floating gear 118 is configured to translate between a first end 166 of the slot 158 and a second end 170 of the slot 158. As the floating gear 118 moves within the slot 158, the floating gear 118 moves into engagement and out of engagement with the drag gear 122. In particular, the floating gear 118 remains enmeshed with the drive gear 114 at all times, but the floating gear 118 is only enmeshed with the drag gear 122 part of the time. In other words, the floating gear 118 and the corresponding floating axis 162 are configured to move with respect to the drive axis 138 and the drag axis 150.

Figure 6:
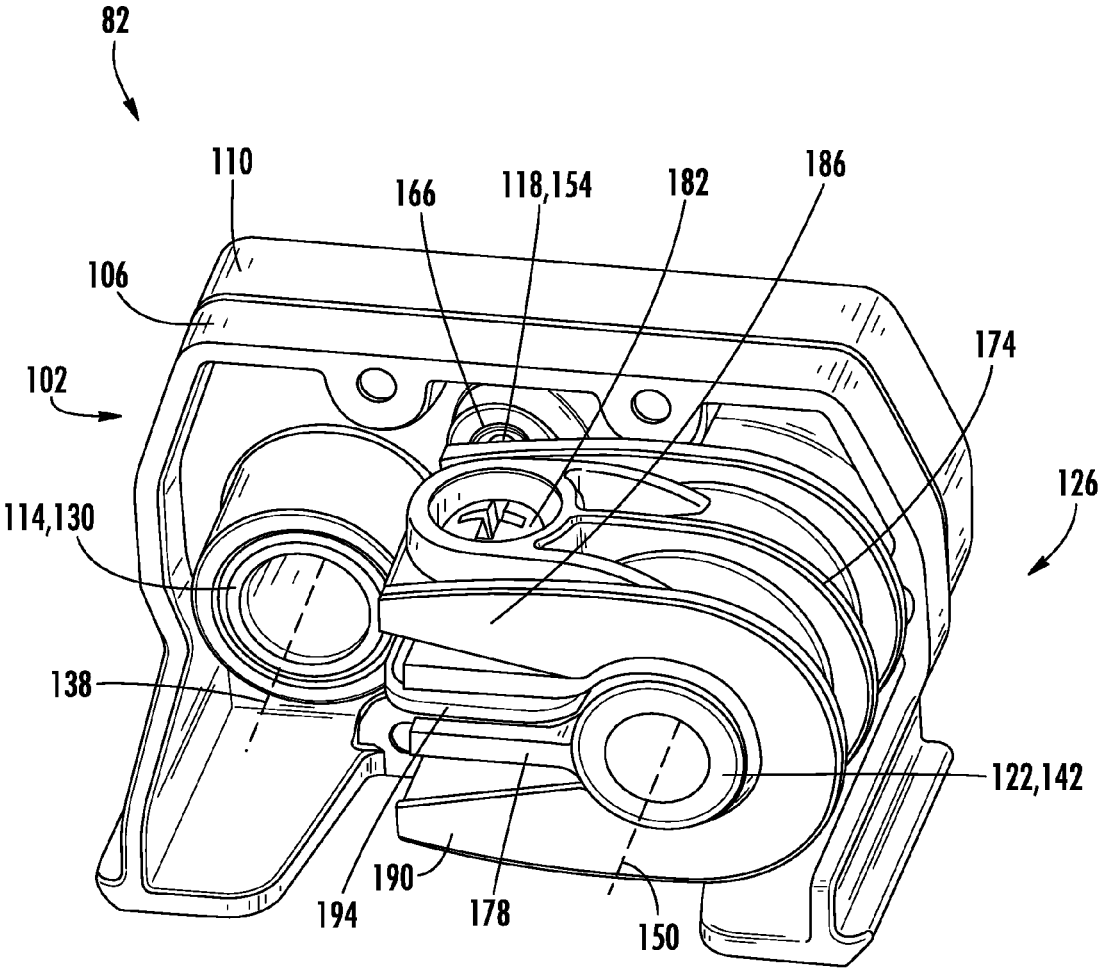
FIG. 6 is another perspective view of the lift regulator of FIG. 4.

With reference to FIG. 6, the adjustable drag mechanism 126 is engaged with the drag gear 122, and more specifically engaged with the hub 142 (i.e., drum) of the drag gear 122. The drag mechanism 126 is adjustable to change the force opposing rotation of the drag gear 122. As will be explained in greater detail below, opposing rotation of the drag gear 122 corresponds to opposing the bottom rail 22 from moving away from the head rail 14. The adjustable drag mechanism 126 includes a clamp member 174, a liner 178, and an adjustment fastener 182. The clamp member 174 at least partially surrounds the hub 142 of the drag gear 122 and includes a first portion 186 and a second portion 190 positioned above and below, respectively, a flange 194 formed on the housing 102. The liner 178 also at least partially surrounds the hub 142 of the drag gear 122, and the liner 178 is positioned on an interior surface 198 of the clamp member 174 between the clamp member 174 and the hub 142. In the illustrated embodiment, the liner 178 is made of a felt or any other suitable low-friction material. In alternative embodiments, the liner is eliminated so that the clamping action of the clamp member 174 operates directly on the hub 142 of the drag gear 122.

The adjustment fastener 182 couples and adjustably positions the first portion 186 of the clamp member 174 relative to the second portion 190 of the clamp member 174. More specifically, the adjustment fastener 182 secures the first portion 186 and the second portion 190 to the housing flange 194 and rotation of the adjustment fastener 182 in a first direction (e.g., clockwise) positions the first portion 186 and the second portion 190 of the clamp member 174 closer together. With the first portion 186 and the second portion 190 are positioned closer together, the clamping force applied by the clamp member 174 through the liner 178 to the hub 142 is increased. Similarly, rotation of the adjustment fastener 182 in a second direction, opposite the first direction (e.g., counter-clockwise), positions the first portion 186 and the second portion 190 of the clamp member 174 further apart, thus decreasing the clamping force applied to the hub 142. As such, the amount of drag (i.e., resistance, brake, etc.) applied to the drag gear 122 is easily adjusted by adjustment of the fastener 182. In other words, the drag mechanism 126 is adjustable to change the force opposing the bottom rail 22 moving away from the head rail 14. In the illustrated embodiment, the drag mechanism 126 is oriented such that the adjustment fastener 182 is accessible from the top of the covering 10, but in alternative embodiments, the adjustment fastener 182 may be accessible from the front, back, or side of the covering 10.

Figure 7A:
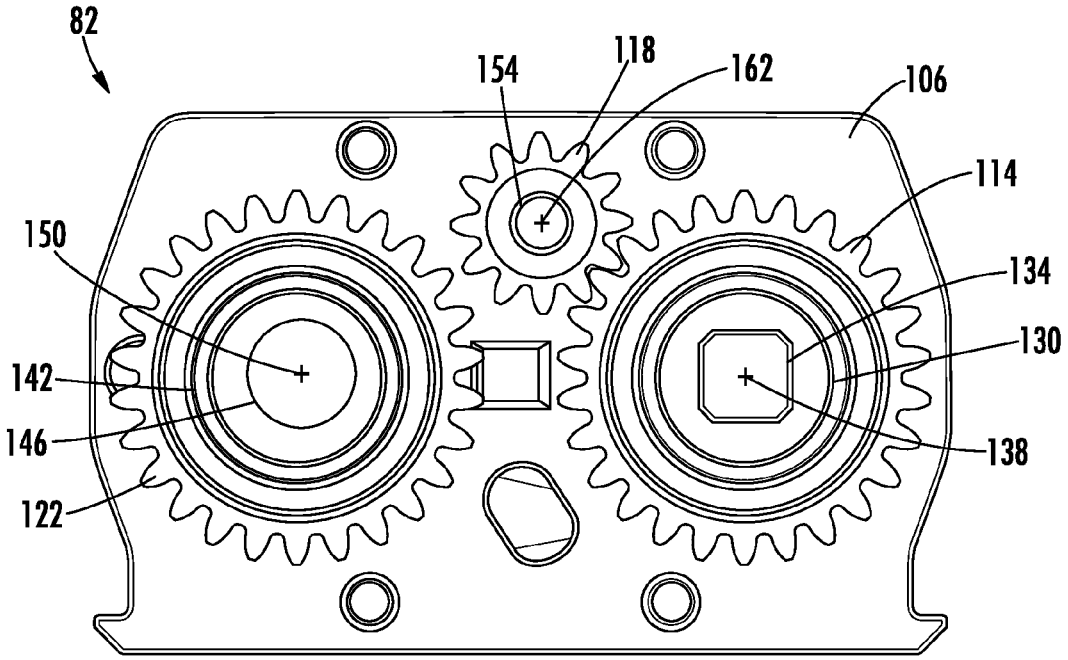
FIG. 7A is a side view of the lift regulator of FIG. 4 with a floating gear in a first position, separated from a drag gear.
Figure 7B:
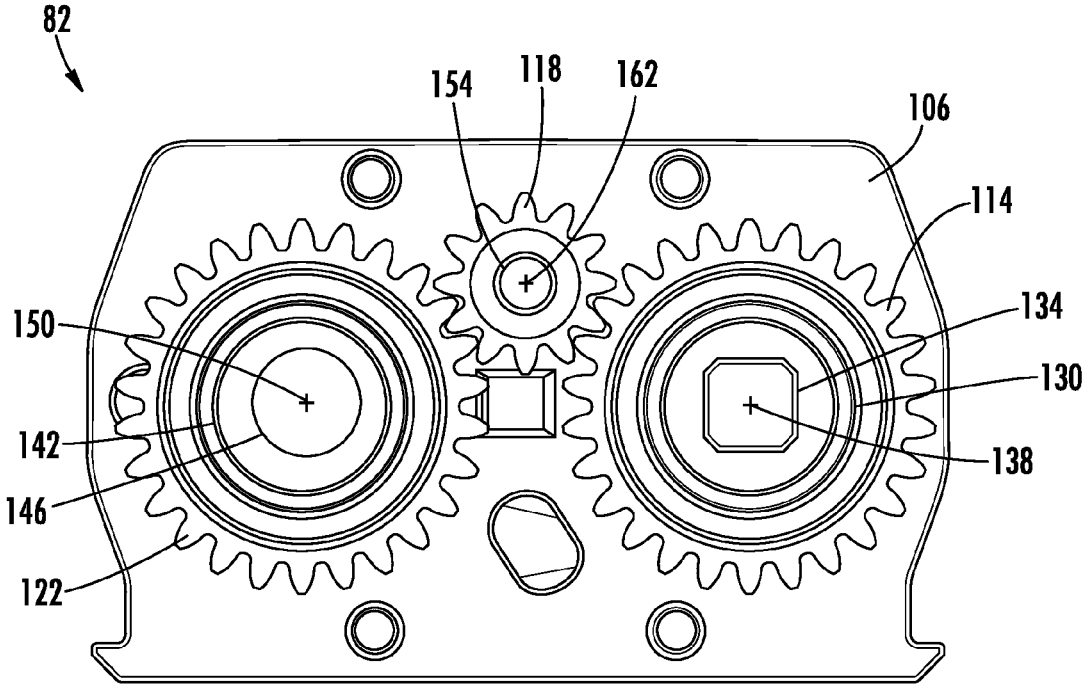
FIG. 7B is a side view of the lift regulator of FIG. 4 with the floating gear in a second position, enmeshed with the drag gear.

With reference to FIGS. 7A and 7B, operation of the lift regulator 82 is explained in greater detail. As the bottom rail 22 is moved away from the head rail 14, the drive shaft 66 rotates in a first direction (i.e., counterclockwise as viewed from FIGS. 7A and 7B). Rotation of the drive shaft 66 in the first direction causes rotation of the drive gear 114 in the first direction. Likewise, as the bottom rail 22 is moved toward the head rail 14, the drive shaft 66 rotates in a second, opposite direction (i.e., clockwise as viewed from FIGS. 7A and 7B). Rotation of the drive shaft 66 in the second direction causes rotation of the drive gear 114 in the second direction.

When the drive gear 114 rotates in the first direction (i.e., counterclockwise as viewed from FIGS. 7A and 7B), the floating gear 118 automatically moves, if the floating gear 118 is not already enmeshed with the drag gear 122, to be enmeshed with the drag gear 122 (i.e., moving from the position shown in FIG. 7A to the position shown in FIG. 7B). In other words, the shaft 154 of the floating gear 118 moves within the oblique slot 158 from the first end 166 toward the second end 170 when the bottom rail 22 moves away the head rail 14. Rotation from the drive gear 114 is then transferred through the floating gear 118 to the drag gear 122, which resists rotation via the adjustable drag mechanism 126. In this way, the floating gear 118 acts as a transmission between the drive gear 114 and the drag gear 122. The floating gear 118 automatically remains enmeshed with the drag gear 122 (FIG. 7B) when the bottom rail 22 (and subsequently the drive shaft 66 and drive gear 114) remain stationary with respect to the head rail 14. In other words, the adjustable drag mechanism 126 in the lift regulator 82 also provides a static brake to hold the bottom rail 22 in position.

When the drive gear 114 rotates in the second direction (i.e., clockwise as viewed from FIGS. 7A and 7B), the floating gear 118 automatically moves, if the floating gear 118 is not already separated from the drag gear 122, to be separated from the drag gear 122 (i.e., moving from the position shown in FIG. 7B to the position shown in FIG. 7A). In other words, the shaft 154 of the floating gear 118 moves within the slot 158 from the second end 170 toward the first end 166 when the bottom rail 22 moves toward the head rail 14. Rotation from the drive gear 114 is no longer transferred to the drag gear 122 through the floating gear 118, which removes any resistance to rotation that the drag mechanism 126 was applying. As such, the lift regulator 82 automatically engages the adjustable drag mechanism 126 to resist the bottom rail 22 from moving away from the head rail 14, and automatically disengages the drag mechanism 126 when the bottom rail 22 moves toward the head rail 14. In other words, when weight is removed from the lift cords 94 as the bottom rail 22 is lifted, the floating gear 118 is lifted upwardly by drive gear 114 rotating in a clockwise direction as shown in FIG. 7A. The floating gear 118 is thereby elevated out of engagement with the drag gear 122. Resistance from drag gear 122 and drag mechanism 126 is no longer transmitted to drive shaft 66, and the bottom rail 22 can be raised without resistance from the drag mechanism 126. As such, the lift regulator 82 provides an adjustable braking force to the bottom rail 22 moving away from the head rail 14 and statically hanging, and provides no braking force to the bottom rail 22 moving towards the head rail 14. The transition between applying a braking force and not applying a braking force is automatically done by the lift regulator (i.e., no additional input or activation is required by the user).

Coverings using lift assemblies with spring motors require that the spring motors be selected for the hanging weight of the shade along with the rail weights to try and achieve a neutral balance. A neutral balance occurs when the covering does not creep either upward or downward after a user has positioned the covering. Because of variables such as blind weight, friction on the cords and springiness in the fabric, the spring motors and weight of the rails must be individually adjusted at assembly to find a suitable balance. For example, cellular and pleated coverings require weight in the bottom rail so the shaped material extends fully in the designed configuration. The rail is weighted sufficiently to at least overcome natural springiness in the shaped material structure. Non-springy materials may require little or no weight added to the bottom rail. The spring motor must have sufficient torque to operate the cord winding mechanism, to reel in the lift cords and to assist in lifting the rail to some degree. However, the spring motor cannot be too strong such that the spring motor lifts the covering individually. Achieving the proper balance between the spring motors and weights can be difficult in conventional designs. Accordingly, it is desirable and advantageous to include the lift regulator 82 that allows easy adjustment to the amount of drag in the lift assembly 54, thereby eliminating the need for swapping spring motors and weights during assembly.

In a conventional design, drag is applied directly to the lift assembly in a continuous fashion. While the drag may be adjustable, the drag is applied equally during both lifting and lowering operation of the blinds. Applying drag equally in both directions is disadvantageous in some applications. In particular, it would be preferred to apply drag only during lowering and when the weight of the covering 10 is hanging, while removing drag when lifting the covering 10 so that the lift cords 94 quickly wind up into the shade head rail 14. As such, the lift regulator 82 automatically moves the floating gear 118 along the slot 158 into and out of engagement with the adjustable drag mechanism 126. More specifically, when the bottom rail 22 is pulled to lower it, or when the bottom rail 22 is hanging with weight on the lift cords 94, the floating gear 118 is shifted along the slot 158 into engagement with the drag gear 122 by rotation of the drive gear 114. The drag gear 122 in combination with the drag mechanism 126 provides resistance to lowering, and also prevents the bottom rail 22 from creeping down once the bottom rail 22 has been positioned.

The lift regulator 82 can be mirrored and placed at the opposite end of the shade head rail 14, or can be located anywhere along the head rail 14. In alternative embodiments, the lift regulator 82 is integrated and incorporated into the spring motor. The location of the lift regulator 82 is convenient since it allows easy access for field adjustment and does not require additional access holes for adjusting tool. Adjustments can be made by simply removing the appropriate covers on the head rail 14 near the lift regulator 82.

While a lift regulator 82 has been shown and described on a multi-panel window covering 10, it should be understood that the lift regulator disclosed herein also can be used advantageously in other window coverings. For example, the lift regulator 82 can be used advantageously in a cordless single panel window covering. The automatic lift regulator 82 can be used advantageously in any so-called "cordless" window covering apparatus that uses a spring motor or motors for operation. Further, the lift regulator 82 can be used in combination with other compensating, adjustment and regulating structures such as added weights, braking mechanisms and the like.

Various features and advantages of the invention are set forth in the following claims.

What is claimed is:

1. A covering for an architectural opening comprising:

a first rail;

a second rail moveable relative to the first rail; and a lift regulator coupled to the first rail;

wherein the lift regulator includes a drag mechanism and the lift regulator automatically engages the drag mechanism to resist the second rail moving away from the first rail; and wherein the lift regulator automatically disengages the drag mechanism when the second rail moves toward the first rail, wherein the lift regulator further includes:

a drive gear;

a floating gear enmeshed with the drive gear; and a drag gear coupled to the drag mechanism;

wherein the floating gear is enmeshed with the drag gear when the second rail moves away from the first rail, and wherein the floating gear is separated from the drag gear when the second rail moves toward the first rail.

2. The covering of claim 1, wherein the lift regulator further includes:

a housing with a slot to receive a shaft of the floating gear;

wherein the shaft of the floating gear moves within the slot from a first position in the slot toward a second position in the slot when the second rail moves away from the first rail.

3. The covering of claim 1, wherein the drag mechanism is adjustable to change the force opposing the second rail moving away from the first rail.

4. The covering of claim 3, wherein the drag gear includes a hub and the drag mechanism includes a clamp member partially surrounding the hub.

5. The covering of claim 4, wherein the drag mechanism further includes a liner positioned on an interior surface of the clamp member.

6. The covering of claim 4, wherein the clamp member includes a first portion and a second portion, and wherein the drag mechanism further includes an adjustment fastener that couples the first portion to the second portion.

7. The covering of claim 6, wherein rotation of the adjustment fastener in a first direction positions the first portion and the second portion of the clamp member closer together to increase the force opposing the second rail moving away from the first rail.

8. The covering of claim 1, wherein the drive gear defines a drive axis and the drag gear defines a drag axis, and wherein the drive axis is parallel to the drag axis.

9. The covering of claim 8, wherein the floating gear defines a floating axis, and wherein the floating axis is parallel to the drive axis and the drag axis and is further configured to move with respect to the drive axis and the drag axis.

10. The covering of claim 1, further comprising a drive shaft and a spring motor coupled to the first rail, wherein the drive shaft is coupled to the spring motor and the drive gear is driven by the drive shaft.

11. The covering of claim 10, wherein the lift regulator is removably coupled to the drive shaft.

12. The covering of claim 1, wherein the lift regulator automatically engages the drag mechanism when the second rail is stationary with respect to the first rail.

13. A lift regulator comprising:

a housing defining a slot;

a drive gear;

a floating gear enmeshed with the drive gear, the floating gear includes a shaft positioned within the slot;

a drag gear; and an adjustable drag mechanism engaged with the drag gear;

wherein the floating gear is enmeshed with the drag gear when the drive gear rotates in a first direction and wherein the floating gear is separated from the drag gear when the drive gear rotates in a second direction; and wherein the drag gear includes a hub and the adjustable drag mechanism includes a clamp member at least partially surrounding the hub.

14. The covering of claim 13, wherein the drag mechanism further includes a liner positioned on an interior surface of the clamp member.

15. The covering of claim 13, wherein the clamp member includes a first portion and a second portion, and wherein the drag mechanism further includes an adjustment fastener that adjustably positions the first portion relative to the second portion.

16. The lift regulator of claim 13, wherein the shaft positioned within the slot moves from a first end of the slot toward a second end of the slot when the drive gear rotates in a first direction.

17. The covering of claim 13, wherein the drive gear defines a drive axis, the drag gear defines a drag axis, and the floating gear defines a floating axis;

wherein the floating axis is parallel to the drive axis and the drag axis and is further configured to move with respect to the drive axis and the drag axis.

18. A covering for an architectural opening comprising:

a first rail;

a second rail moveable relative to the first rail;

a spring motor coupled to the first rail and drivingly coupled to a drive shaft; and a lift regulator coupled to the first rail, the lift regulator includes a drive gear coupled to the drive shaft;

a floating gear enmeshed with the drive gear, a portion of the floating gear positioned within a slot;

a drag gear including a hub;

an adjustable drag mechanism partially surrounding the hub of the drag gear;

wherein the drive gear rotates in a first direction when the second rail is moved away from the first rail; and in a second direction when the second rail is moved toward the first rail;

wherein the floating gear is enmeshed with the drag gear when the drive gear rotates in the first direction and;

wherein the floating gear is separated from the drag gear when the drive gear rotates in the second direction.

* * * * *